United States Patent [19]

Thomas

[11] Patent Number: 4,919,017

[45] Date of Patent: Apr. 24, 1990

[54] HOSE CLAMP TOOL

[76] Inventor: William E. Thomas, 5048 Genesee Rd., Lapeer, Mich. 48446

[21] Appl. No.: 303,500

[22] Filed: Jan. 27, 1989

[51] Int. Cl.[5] ..... B25B 27/20

[52] U.S. Cl. ..... 81/9.3; 81/356; 81/363; 29/229

[58] Field of Search ..... 81/9.3, 355, 356, 362, 81/363, 128, 129, 361, 367; 29/229, 243.56

[56] References Cited

U.S. PATENT DOCUMENTS

| | | | |
|---|---|---|---|
| 1,029,142 | 6/1912 | Reeves . | |
| 1,051,727 | 1/1913 | Gardner . | |
| 1,072,301 | 9/1913 | Blake . | |
| 2,156,187 | 4/1939 | Medved | 81/9.3 |
| 2,362,112 | 11/1944 | Capra | 81/9.3 |
| 2,677,982 | 5/1954 | Arras et al. | 81/9.3 |
| 2,910,899 | 11/1959 | Pasqualone et al. | 81/9.3 |
| 3,091,143 | 5/1963 | Coy | 81/9.3 |
| 3,161,086 | 12/1964 | Kircher | 81/9.3 |
| 4,188,023 | 2/1980 | Whaley | 81/356 |
| 4,300,415 | 11/1981 | Saila | 81/363 |

*Primary Examiner*—Roscoe V. Parker
*Attorney, Agent, or Firm*—Charles W. Chandler

[57] ABSTRACT

A hose clamp tool has juxtaposed jaws on one end of elongated members, one of which slides within the other to move the jaws toward each other to force the lugs of a hose clamp toward each other. That expands the circular part of the clamp, allowing it to fit over the end of a hose. Longitudinal movement of one elongated member relative to the other is accomplished by a handle pivotally mounted on one of the members extending toward the jaws. One end of a link is pivotally connected to an intermediate part of the handle, and the other end of the link is pivotally connected to the other member.

17 Claims, 3 Drawing Sheets

HOSE CLAMP TOOL

BACKGROUND OF THE INVENTION

This invention relates to a tool to perform mechanical operations in hard-to-reach locations. In particular, it relates to a tool to install and remove hose clamps in the crowded engine compartment of a modern automobile.

The engine compartment of a typical automobile has become increasingly crowded in recent years, partly as a result of the reduction in size of the whole car and partly because of the many new devices being packed into the engine compartment. As a result, both those assembling the car and those working on it to maintain it in good condition or to repair it have great difficulty in reaching some of the parts. Radiator and heater hoses are among the parts that are particularly difficult to reach. In addition to being accessible only with great difficulty, each end of each of these hoses is clamped onto a nipple on the radiator, heater, or engine by a resilient circular clamp that squeezes the end part of the hose tightly and binds it watertight to its nipple. The clamp can be loosened only by exerting considerable pressure in the proper direction on lugs extending outwardly from each end of the circular main part. This pressure on the lugs to move them toward each other expands the diameter of the circular main and must be done either to install a new hose on a nipple or to remove a hose that must be replaced. In some instances, a clamp is installed so that its lugs are not in position to allow the necessary pressure to be exerted on them to loosen the clamp when it is necessary to remove it, and for this and other reasons, it is sometimes necessary that large components of the car be removed or loosened to make it possible to reach a particular hose clamp.

Workers on an assembly line have the advantage of having powered tools with which to manipulate a hose clamp to install it on a hose and the hose on a nipple as a car is being built, and they have the additional advantage that the order of assembly of parts can be arranged to allow the hose clamps to be installed when there is as much access as possible to the locations where those clamps must be fitted. However, the power tools sometimes apply too much power in squeezing a clamp and stress it beyond its elastic limit. In addition, even when the order of assembly is chosen carefully, it is not always possible to provide the amount of room necessary for a power-assisted tool.

Efforts have been made in the past to provide tools to manipulate circular, resilient hose clamps. U.S. Pat. Nos. 2,677,982, Arras et al., and 3,161,086, Kircher, show tools in the form of pliers to grip a clamp formed of spring rod having a round cross section bent into an arc of greater than 360° and provided with ends that extend approximately perpendicularly to the arcuate part. The arms of the pliers extend much father apart than would be permissible in the cramped engine compartment of modern car, and it would be necessary for a person using the pliers to reach into the immediate vicinity of the clamp location, something that is frequently physically impossible in today's cars. Moreover, pliers are normally held so that their pivot pin is between the user's hand and the hose clamp, which is not ergonomically correct for the installation of hose clamps in crowded engine compartments.

Pasqualone et al. show a tool that uses a threaded rod to transmit pressure to the ends of a clamp. While the cross-section of the tool at the end that grips the clamp is of minimal size, the threaded rod would take a long time to operate to install or remove each clamp. One of the requirements of mass production of automobiles is that every operation be carried out in as short a time as is possible. Even in the case of replacement of a hose and hose clamp in a repair station, where hose clamps are not put on nearly as often as on an assembly line, time is important, and operation of the threaded mechanism of Pasqualone et al. would take too long.

Reeves shows a wrench U.S. Pat. No. 1.029,142 in which a first member encircles a second, straight member to be guided by the latter to slide along it to force two jaws, one on each of the two members, toward each other in response to pivotal movement of a handle pivoted on the second member. The handle is connected to the sliding part by two links, and, as in the case of the pliers of Kircher and Arras et al., is pivoted at a location between the jaws and the user's hands.

Similarly, U.S. Pat. No. 1,051,727 to Gardner shows a wrench that has two handles, one of which is pivotally supported on the other at a location between the jaws and the part of the latter handle held by a user.

OBJECTS AND SUMMARY OF THE INVENTION

It is an object of this invention to provide an improved tool to hold resilient parts under pressure in locations that are difficult to reach but where the resilient parts must be installed or from which they must be removed.

Another object of this invention is to provide a tool to grip the lugs on a resilient hose clamp easily and quickly to expand the circular body of the clamp to allow it to be pushed onto or pulled off of an elastomeric hose with a minimum of effort and in a minimum time.

Still another object of the invention is to provide a tool arranged to grasp a hose clamp in the best position to install it easily on a hose in an almost-inaccessible location or to remove the hose and clamp from such a location.

A further object of the invention is to arrange a hose clamp with due regard to ergonomics so that the parts of it that must be moved relative to each other are located where such movements conform to the natural movements and positions of the arms and hands of the person using the tool.

Still further objects will become apparent to those skilled in the arts associated with the manufacture and use of such tools after such persons have read the following description in conjunction with the drawings.

In accordance with this invention, an elongated, rigid member is provided with a jaw at one end. A second member is connected to the first member to slide along it and is provided with a second jaw that confronts the first jaw. The juxtaposed surfaces of the jaws are shaped and arranged to grip the lugs that extend from the circular body of a resilient hose clamp, and the jaws are moved toward and away from each other by a handle pivotally attached to an axle on one of the members and connected to the other member by a link. One end of the link is pivotally attached to the handle and the other end is pivotally attached to the other member. The handle extends from the axle toward the jaws and the link is between the axle and the jaws so that, as the handle is moved,the link applies pressure to the other member to draw its jaw toward the other jaw and force toward each other the two hose clamp lugs held by those jaws. This stresses the resilient, circular body of the clamp and expands both its circumferential and radial dimensions to allow it to slip over the end part of an elastomeric hose or to allow that part of the hose to slip into the circular body without much difficulty or even with none at all.

For the sake of safety, it is desirable that the handle and the link connecting the handle to one of the members be pivoted on axes so located as to result in over-center action to hold the clamp tightly in response to its own resilient force until the handle is deliberately pivoted in the opposite direction by the person using the tool. Such reverse pivoting releases the clamp and allows it to return toward its original diameter, which is small enough to apply pressure around the entire circumference of the hose to press it against a rigid nipple firmly enough to join the hose fluid-tight to the nipple.

DETAILED DESCRIPTION OF THE PREFERRED EMBODIMENT

Figure 1:
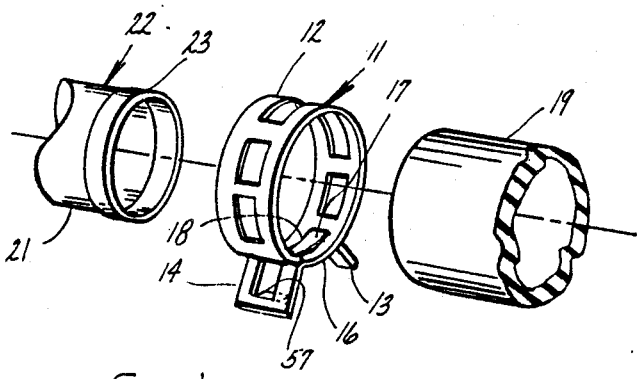
FIG. 1 is a perspective view of a fragment of a hose, a nipple, and one embodiment of a resilient hose clamp of a type that the tool of this invention is intended to manipulate.

FIG. 1 shows a perspective view of one type of resilient split hose clamp 11 made of sheet spring material formed to have a circular main part 12 and two end lugs 13 and 14 that extend approximately perpendicularly from the main part. The arcuate length of the strip of resilient material in the main part is greater than the 360° necessary to form a complete circle. In fact, it is typically about 420° to about 460° when the clamp is in its normal, unstressed condition. One end 16 of the arcuate main part has a central slot 17 and the other arcuate end part 18 has a symmetrically reduced width to fit in the slot so that there is no tendency for the clamp 11 to twist while being installed or removed.

The normal, relaxed condition of the hose clamp 11 is such that its circular main part 12 has a diameter a little less than the outer diameter of the end part 19 of an elastomeric hose. The inner diameter of the end part 19 is just large enough to fit over the tubular part 21 of a nipple 22 that may be attached to the radiator or heater or engine block of an automobile or may be attached to any other device to which an elastomeric hose needs to be connected in a water-tight manner. The nipple 22 in this instance is shown as having a bead 23 at its outer end to help make the joint between the nipple and the end part 19 of the hose water-tight.

In order to assemble the components shown in FIG. 1, the lugs 13 and 14 are pressed together, which enlarges the circumference and the diameter of the circular main part 12 of the hose clamp 24. The circular part can then be slipped over the end part 19 of the hose and the hose forced on the end of the nipple 22, or the circular main part 12 can be held loosely over the tubular part 21 of the nipple and the end part 19 of the hose can be forced over the bead and into the annular space between the tubular part 21 and the circular main part 12 of the clamp 11. In any case, after the end part 19 of the hose has reached a proper location on the nipple 22 and inside the circular part 12, pressure forcing the lugs 13 and 14 toward each other is released to allow the circular part 12 of the hose clamp to return toward its relaxed or unstressed condition. However, the presence of the end part 19 of the hose prevents the circular part 12 of the hose clamp from returning entirely to its original diameter. The resilient force that causes it to try to do so is exerted inwardly around the entire circumference of the end part 19 of the hose, thereby forcing the inner surface of that part of the hose firmly against the external surface of the tubular part 21 of the nipple so as to make a completely water-tight joint between the hose and the nipple.

Figure 2:
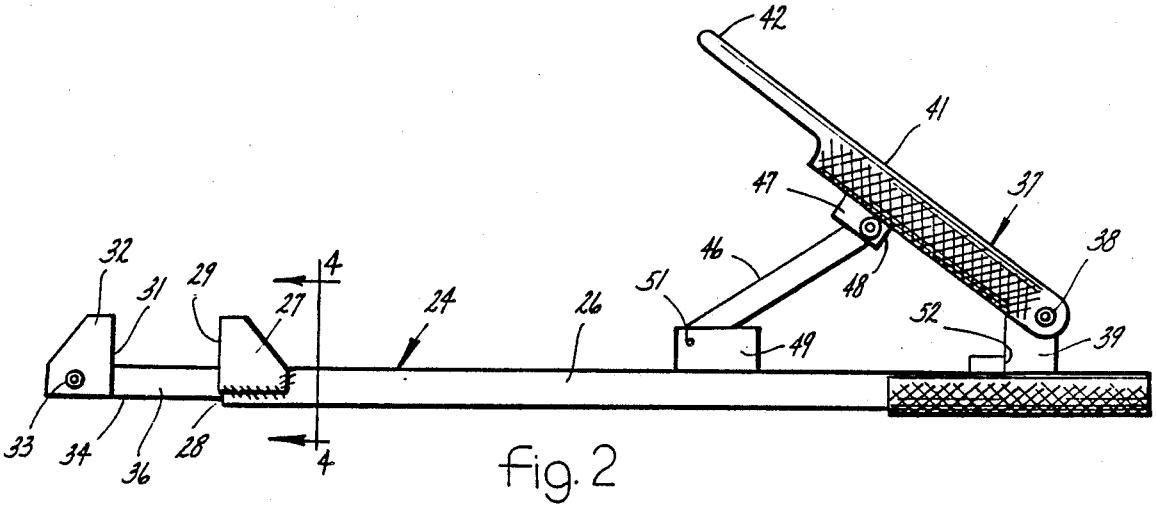
FIG. 2 is a side view of one embodiment of this invention in the initial stage of grasping a hose clamp of the type shown in FIG. 1.

FIG. 2 shows a hose clamp tool 24 to apply the necessary pressure to the lugs 13 and 14 to cause them to move toward each other and thereby stress the circular part 12 of the hose clamp 11. The tool includes a first elongated member 26, which is shown in this embodiment as being a closed metal tube of sufficient strength to withstand the forces that will be applied to the tool in normal use. The first member 26 has a first jaw 27 firmly attached to one end 28 of the tube. The jaw has a pressure surface 29 facing away from the remainder of the elongated tube 26 and confronting the pressure surface 31 of a second jaw 32 firmly attached by means of a locking device such as a roll pin 33 to the first end 34 of a second elongated member 36. The cross-sectional dimensions of the member 36 are such that member 36 slides easily in the longitudinal direction in the tube 26 to allow the pressure surfaces 29 and 31 to be moved far enough apart to grasp the lugs 13 and 14 (see FIG. 1) of an unstressed hose clamp 11.

Figure 3:
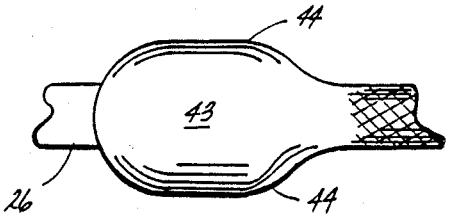
FIG. 3 is a top view of a fragment of the tool in FIG. 2.

The mechanism to actuate the jaws 29 and 31 to move them relative to each other is located at the second end of the elongated tube 26. This mechanism includes a handle 37 pivotally mounted on an axle 38 held in a projection 39 attached to one of the elongated members, which is the member 36 in this instance. The axle 38 may be any of a number of devices that hold the handle 37 so that it can be pivoted. For example, the axle can be a shoulder bolt or a pin, including a roll pin, or a rivet or the like. The handle includes a knurled, cylindrical part 41 to be gripped by the fingers of the person using the tool and at its free end 32 it may be flattened out, as shown in the top view at FIG. 3, to provide a lateral projection 44 in a convenient place to allow the user of the tool to push outwardly with his thumb to pivot the handle 37 to the position shown in FIG. 2 and away from the elongated tube 26. The fattened free end also makes it more comfortable for a user to press down on it with his palm to force the jaws 27 and 32 to close upon the lugs 13 and 14 (FIG. 1) of the hose clamp.

In this embodiment, the handle 37 is connected to the elongated tube 36 by a link 46 pivoted at each end. The first end of the link is pivotally connected to the handle 37 by means of a clevis 47 welded or otherwise firmly affixed to the handle at a location intermediate its length. The pivotal connection between the link 46 and the clevis 47 may be any sort of device that allows pivoting motion, as in the case of the axle 38. Specifically, the connecting device 48 between the link and the clevis may be a shoulder bolt with an Allen head or any other suitable head or it may be a rivet or solid pin or roll pin or the like. The other end of the link 46 is similarly pivotally connected to another clevis 49 welded or otherwise firmly affixed to the tube 26 and supporting another pivotal connector 51 to allow the link 46 to pivot freely with respect to the tube 26.

The tool 24 also includes a stop 52 rigidly attached to the tube 26 at the limit of the range of linear movement of the projection 39 along the tube 26. On the opposite side of the tube from the stop 52 is a cylindrical hand-grip 56 to provide comfortable and secure means for holding the tool in use.

Figure 4:
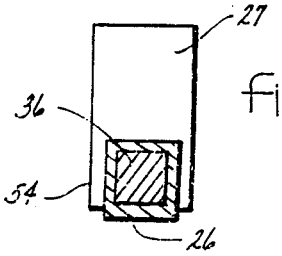
FIG. 4 is a cross-sectional view of the tool in FIG. 2 along the line 4—4 in that figure.

In this embodiment the tube 26 is a polygonal structure more specifically a square as shown as FIG. 4. The inner elongated member 36 has a cross-sectional configuration that matches the inner surface of the tube 26 so that, in this instance, the elongated member 36 is square. The square shape of the tube 26 in FIG. 4 makes it convenient to form the jaw 27 in a saddle shape with projecting lower sides 54 and 56 that are integral with the upper part of the jaw and extend down alongside the tube 6 to be welded to it. The jaw 32 in FIG. 2, is also in the form of a saddle that fits over the end part of the inner elongated member 36.

Figure 5:
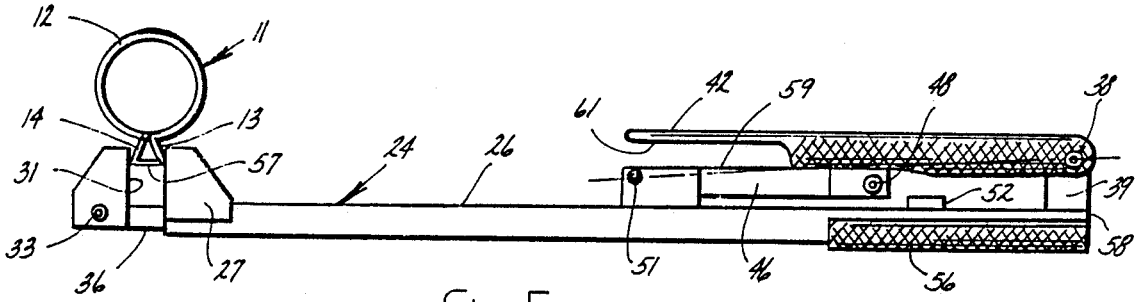
FIG. 5 is a side view of the tool in FIG. 2 with a hose clamp of the type shown in FIG. 1 firmly held by it.

FIG. 5 shows the tool 24 holding the lugs 13 and 14 of the hose clamp 11. This type of hose clamp is designed so that the lugs 13 and 14 should not be forced into contact with each other, and in order to prevent that from happening, a tongue 57 extends from the lug 14 toward the lug 13 to limit the extent to which those lugs can be pushed toward each other. Accordingly, the elongated members 26 and 36 are arranged so that the pressure surfaces 29 and 31 of the jaws 27 and 32 can, at most, approach each other to the extent determined by the tongue 57 and cannot approach each other more closely than that. In this position of closest approach of the lugs 13 and 14, the handle 37 is substantially parallel to the tube 36 and, specifically, to the hand-grip 56. It will be observed that the projection 39 is all the way at the end 58 of the tube 26.

The pressure exerted by the resilient force of the stressed hose clamp, itself, is used to hold the clamp securely in this position by an over-center operation. That requires that the axis of the connecting device 48 be closer to the elongated members 26 and 36 than is the closest part of a line 59 that passes through the axes of the connecting device 51 and the axle 38. This is the condition required for over-center action of the handle 37, and when the axes of the pivot pins, for axles 38, 48, and 51 are related in position in this way, the resilient force that tends to spread the lugs 13 and 14 apart is constrained to force the link 46 toward the tube 26 and thus to maintain the hose clamp 11 securely captured. However, only a relative small pressure on the lower surface 61 of the free end part 42 of the handle 37 is needed to overcome the over-center operation and push the handle 37 out to the position shown in FIG. 2, thereby releasing the lugs 13 and 14 and allowing them to spring apart and constrict the circular part 12 of the hose clamp 11 tightly about the end portion 19 of the hose.

Figure 6:
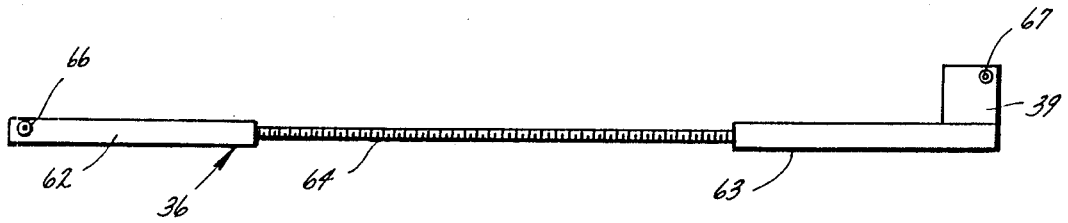
FIG. 6 is a side view of the internal member in the tool in FIGS. 2 and 5.

FIG. 6 shows one embodiment of the elongated member 36. In this embodiment, the member 36 is not a single component but is divided into three parts: a first end part 62, a second end part 63, and a threaded central part 64 that is rigidly attached to both end parts and threadably engages at least one of the end parts 62 or 63. This permits the overall length of the member 36 to be adjusted so that the pressure surfaces 29 and 30 will not approach each other more closely then is desired. That relationship between the pressure surfaces is illustrated in FIG. 5. The first end part 62 has a hole 66 to receive the pin 33 shown in FIG. 5 and the projection 39 is integrally formed with or rigidly attached to the second part 63 to extend perpendicularly from it in a manner similar to a flag. The projection 39 has a hole 67 to receive the axle 38 shown in FIG. 5.

Figure 7:
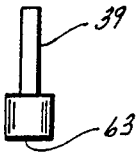
FIG. 7 is an end view of the internal member shown in FIG. 6.

As shown in FIG. 7, which is an end view of the structure in FIG. 6, the projection 39 extends symmetrically from the center of one side of the end part 63 so that the central plane of the projection 39 is also the central plane of the end part 63, and, in fact, of the entire second elongated member 36.

Figure 8:
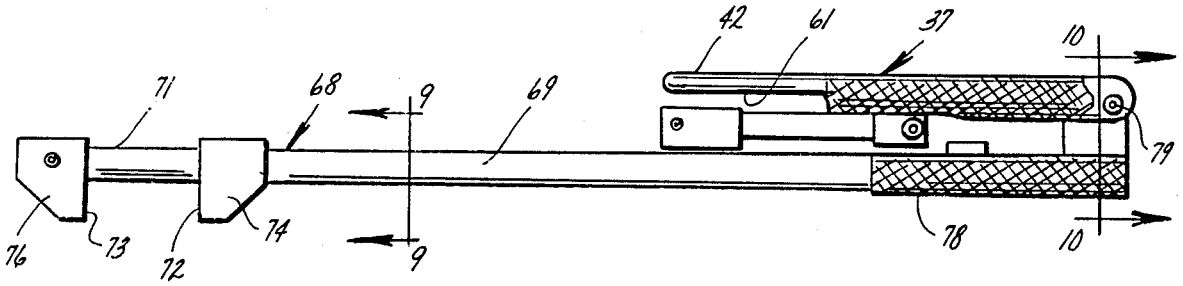
FIG. 8 is a modified embodiment of the tool in FIGS. 2 and 5.

FIG. 8 shows a tool 68 very much like the tool 24 in FIG. 2. However, the first elongated member of the tool 68 is a hollow, round tube 69, and the second elongated member 71 is also round. The second elongated member 71 is longer than the first elongated member 69 by the amount that the second member has to project beyond the first member to allow pressure surfaces 72 and 73 of jaws 74 and 76 on the first and second members 69 and 71, respectively, to be spread apart far enough to receive the lugs of a hose clamp.

Figure 9:
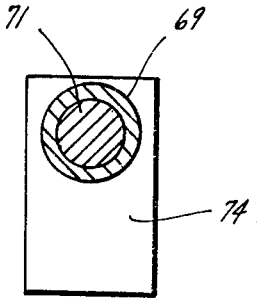
FIG. 9 is a cross-sectional view of the tool in FIG. 8 along lines 9—9 in that figure.

As shown the cross-sectional view in FIG. 9, a hole is bored through the jaw 74 to fit on the tube 69. The jaw 74 is welded to the tube 69 to keep the jaw affixed in one position, both longitudinally and in angular orientation. The jaw 76 is bored to receive the round rod 71 and is held thereon in a fixed position by a locking pin similar to the aforementioned locking pin 33.

It will be noted that the jaws 74 and 76 are on the opposite side of the elongated members 69 and 71 from the side on which the handle 37 and the clevis 49 are mounted. This is to accommodate those cars in which the hose clamps can be more easily manipulated by jaws extending toward the rear, as the side opposite the handle will arbitrarily designate. In fact, the jaws 74 and 75 can be mounted at any angular orientation around the members 69 and 71, if desired.

Figure 10:
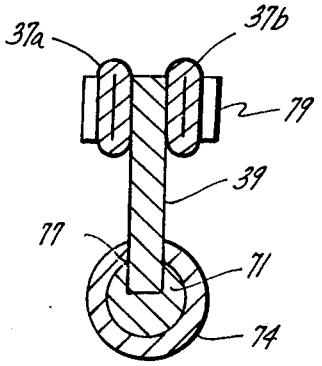
FIG. 10 is a cross-sectional view of the tool in FIG. 8 along the line 10—10 in that figure.

FIG. 10 shows that the round rod 71 is prevented from rotating in the round tube 69 by the flat projection 39 that extends through a close-fitting slot 77 in the knurled end part 78 (see FIG. 8) of the tube. FIG. 10 also shows that the end of the handle 27 is split into two parts 37A and 37B, one on each side of the projection 39. A rivet 77 extends through the projection 39 and through both parts 37A and 37Bb of the handle.

Figure 13:
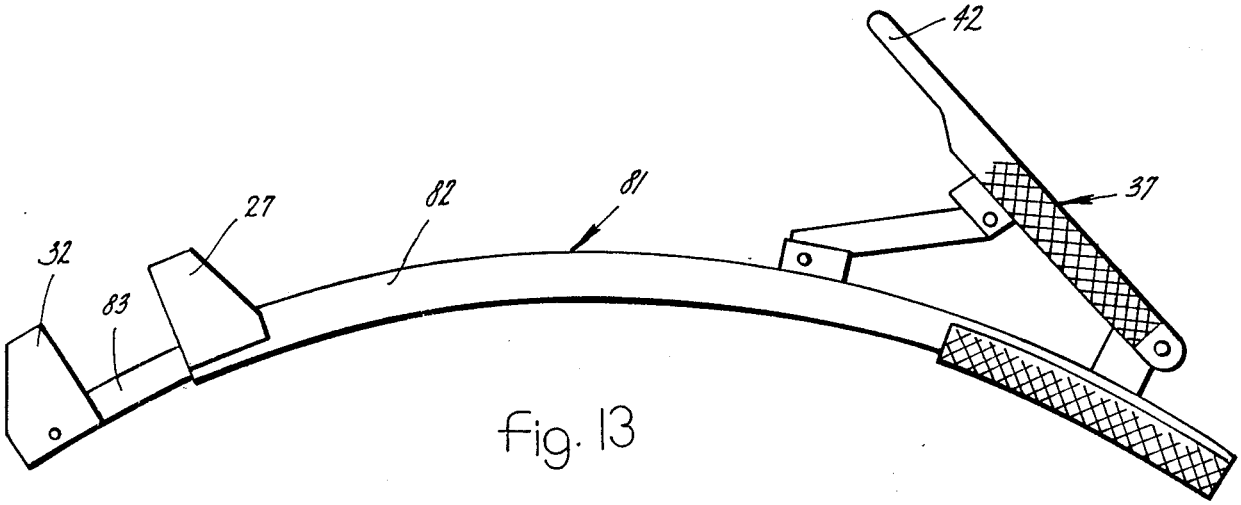
FIG. 13 is another embodiment of a hose clamp tool according to this invention.

FIG. 13 shows another embodiment 81 of the tool 24 in FIG. 2. The only difference is that both elongated members 82 and 83 are bent to allow the jaws 27 and 32 to reach hose clamp locations that are inaccessible to the straight tool 24 in FIG. 2.

Figure 11:
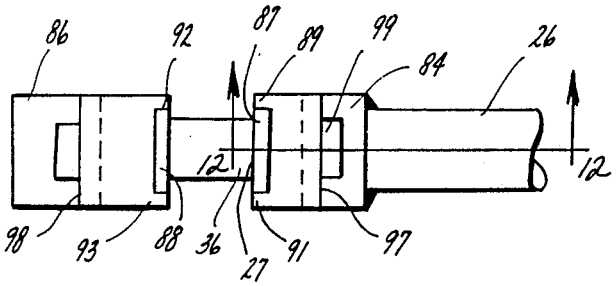
FIG. 11 is a top view of a fragment of a modified embodiment of the tool in FIGS. 2 AND 5.
Figure 12:
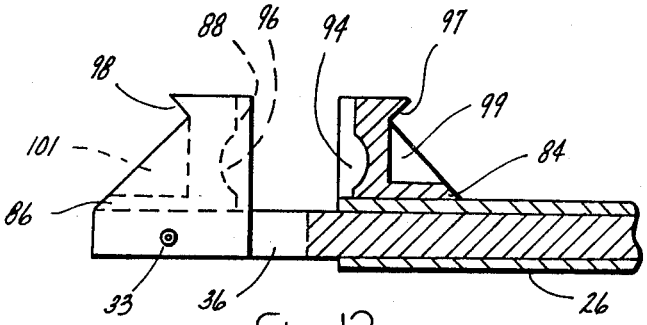
FIG. 12 is a side view, partly in cross section, of the fragment of the tool in FIG. 11.

FIGS. 11 and 12 show a modified embodiment of jaws 84 and 86 mounted on the tube 26 and the inner elongated member 36 in FIG. 2. In the top view in FIG. 11, it will be noted that the pressure surfaces 29 and 31 of the jaws 84 and 86, respectively, are not flat but have recesses 87 and 88, respectively. In FIG. 11 the recesses are shown as being only a little narrower than the widths of the jaws, and there are thin walls 89 and 91 between the recess 87 and the outer surfaces of the jaw 27 and similar thin walls 92 and 93 between the recess 88 and the outer surface of the jaw 32. In FIG. 12, the recesses 87 and 88 are shown as having cylindrically curved inner wall portions 94 and 96, respectively, and the width of the recesses and the configurations of the inner walls thereof are arranged to accommodate the width of the wider lug 14 (FIG. 1) and the secure holding surfaces for grasping both lugs of the hose clamp 11. While these recesses 87 and 88 are illustrated in FIGS. 11 and 12, they can be used on the jaws 27 and 32 in FIGS. 2 and 5 and the jaws 74 and 76 in FIG. 8.

FIGS. 11 and 12 also show hooks 97 and 98 that can be used to hook the lugs 13 and 14 on a hose clamp that was previously installed in an orientation that does not permit the lugs to be gripped by the jaws. By hooking the appropriate lug and pulling or pushing it in the proper direction, the clamp can be rotated to an accessible angular orientation. The jaws 87 and 88 also have recesses 98 and 101 so that either jaw 87 or 88 can accommodate the lug 14 with the tongue 57 in the recess 99 or 101 of that jaw.

Having described my invention, I claim:

1. A hose clamp tool to overcome the resilient force of a resilient, circular hose clamp and force the lugs at the arcuate ends of the clamp toward each other to increase the diameter of the clamp enough to allow the clamp to move along an elastomeric hose, the tool comprising:

first and second elongated members, the first elongated member comprising a rigid tube having first and second ends;

a first jaw joined to the first end of the tube and comprising a pressure surface facing away from the second end, the second elongated member extending along the tube and being guided by it to slide longitudinally along it and having a first end extending beyond the first end of the tube and a second end in the vicinity of the second end of the tube;

a second jaw joined to the first end of the second elongated member and comprising a pressure surface facing the pressure surface of the first jaw;

an axle on one of the elongated members remote from the first end of that member;

a handle pivotally mounted on the axle to pivot relative to the elongated member on which it is mounted and having a free end that moves arcuately relative to that member and extends toward the first end thereof; and a link having a first end pivotally attached to the handle to pivot about a first axis located between the axle and the free end of the handle and having a second end pivotally attached to the other elongated member to pivot about a second axis fixedly located relative to the latter elongated member, whereby moving the handle in one direction moves the pressure surfaces of the jaws toward each other to grasp the lugs of a hose clamp and move them toward each other to increase the diameter of the hose clamp, and moving the handle in the opposite direction moves the pressure surfaces apart to release the hose clamp lugs.

2. The tool of claim 1, in which the axle is mounted on the second elongated member.

3. The tool of claim 2, in which the rigid tube has a longitudinal slot extending from its second end toward its first end, and the second elongated member comprises a rigid plate extending laterally from the second elongated member through the slot, and the axle is mounted in the rigid plate.

4. The tool of claim 2, in which the first and second axes are parallel to each other and to the axis of the axle, and each of the axes is offset laterally from the elongated tube by amounts such that, when the handle is moved so that its free end is at the end of its range of movement toward the elongated tube, the first axis is between the rigid tube and a straight line that passes through the second axis and the axis of the axle, whereby the handle has an over-center locking action.

5. A tool comprising:

a first rigid elongated member (26) having first and second ends;

a first jaw (27) joined to the first end of said first member, said jaw having a pressure surface;

a second rigid elongated member (36) extending along said first rigid member for slidable motion therealong; said second member having first and second ends thereof in near adjacency to respective ones of the first and second ends of the first member;

a second jaw (32) joined to a first end of the second member, said second jaw having a pressure surface facing the pressure surface of the first jaw;

an axle (38) carried on the second end of the second elongated member remote from said second jaw;

a handle (37) having one end thereof pivotally connected to the axle so that the handle can move toward or away from said second elongated member;

a link (46) having a first end thereof pivotally attached to said handle at an intermediate point therealong, said link having a second end thereof pivotally attached to said first elongated member at an intermediate point therealong; whereby manual motion of the handle toward said second elongated member causes the jaws to move closer together, and manual movement of the handle away from said second elongated member causes the jaws to move further apart;

said first elongated member having a handgrip section (56) thereon near its first end for manual gripment while the handle is being moved toward or away from said second elongated member; the link and handle being oriented so that said axle moves bodily along said handgrip section as the handle pivots on the axle;

said axle being oriented to the pivot connections between the link, the handle and the first elongated member so that the handle has an overcenter locking action as it nears the second elongated member.

6. The tool of claim 5, comprising a projection (39) extending in one direction from one side of said elongated member, said axle being mounted on said projection whereby the handle is on said one side of said elongated member; said jaws extending from the respective elongated members in said one direction.

7. The tool of claim 5, comprising a projection (39) extending in one direction from one side of said elongated member, said axle being mounted on said projection whereby the handle is on said one side of said elongated member; said jaws extending from the respective elongated members in a different direction than said one direction.

8. The tool of claim 5, in which the first member is straight.

9. The tool of claim 8, in which the first member is a hollow tube and the second member comprises:

first and second end parts shaped to fit in the hollow tube and to slide smoothly therein; and a central part connected to the juxtaposed ends of the end parts, the connection to at least one of the end parts being a threaded connection.

10. The tool of claim 5, in which the first member is bent intermediate its first and second ends.

11. The tool of claim 5, in which the second end of the second member is close to the second end of the first member and has a projection extending from it, the axle being mounted in the projection.

12. The tool of claim 11, in which the first member is a hollow tube, and the second member is a bar longer than the hollow tube and extending through the tube to be guided by the tube for longitudinal movement in it, the tube having a longitudinal slot adjacent its second end, and the projection extending through the slot and sliding in it to be guided by it.

13. The tool of claim 12, comprising reinforcing means (52) on the hollow tube at the end of the slot close to the first end of the tube to receive the shock of the projection striking that end of the slot.

14. The tool of claim 5, in which the second jaw comprises a channel in which the first end of the second member fits, and the tool further comprises a pin extending through portions of the second jaw defining the sides of the channel and through the portion of the second member within the channel to retain the second jaw rigidly on the first end of the second member.

15. The tool of claim 5, in which the free end of the handle comprises a laterally extending projection to receive pressure on the side thereof facing generally toward the hollow tube to move the handle away from the hollow tube.

16. The tool of claim 5, in which the pressure surface of the first jaw faces away from the second end of the first member and is perpendicular to the first member, and the first jaw further comprises hook means on the side of the first jaw facing the second end of the first member.

17. The tool of claim 16, in which the pressure surface of the second jaw faces toward the first end of the first member and the second jaw further comprises hook means on the side of the second jaw facing away from the first end of the first member.

* * * * *